United States Patent [19]

Hunt

[11] 4,066,026

[45] Jan. 3, 1978

[54] WORK TRANSPORT APPARATUS FOR USE WITH A BUTTON ATTACHMENT MACHINE

[76] Inventor: Morris Dean Hunt, P.O. Box 315, Dickey Woods, Adamsville, Tenn. 38310

[21] Appl. No.: 659,891

[22] Filed: Feb. 20, 1976

[51] Int. Cl.[2] ..... D05C 9/04

[52] U.S. Cl. ..... 112/121.15

[58] Field of Search ..... 112/121.12, 121.11, 112/121.15, 121.26, 67, 65, 70, 76, DIG. 2, DIG. 3; 269/152, 153

[56] References Cited

U.S. PATENT DOCUMENTS

| | | | |
|---|---|---|---|
| 2,768,592 | 10/1956 | Bihaly | 112/121.15 |
| 3,228,364 | 1/1966 | Kremer et al. | 112/DIG. 3 |
| 3,334,600 | 8/1967 | Conner, Jr. | 112/67 X |
| 3,463,101 | 8/1969 | Ansel | 112/121.15 |
| 3,722,436 | 3/1973 | Strouse | 112/121.11 |
| 3,970,017 | 7/1976 | Babson et al. | 112/121.12 |
| 4,013,025 | 3/1977 | Marforio | 112/121.15 |

*Primary Examiner*—Werner H. Schroeder
*Assistant Examiner*—Peter Nerbun
*Attorney, Agent, or Firm*—Ralph W. Kalish

[57] ABSTRACT

This apparatus includes a carriage by which a garment workpiece is moved relative to a stationary fastener applicator unit. The workpiece is held extended between pneumatically actuated clamping units mounted to the carriage which apply a tensioning force to the workpiece while fasteners are being applied sequentially thereto during dwell periods between intermittent advancements of the carriage. A latching and indexing assembly is provided which includes a locating pin that precisely secures the carriage in each of a series of predetermined locations during the dwell periods, to assure accurate placement of the fasteners on the workpiece. A sensing device detects any malfunctioning of the applicator machine and should such malfunction occur, stops the apparatus.

17 Claims, 11 Drawing Figures

FIG. 1
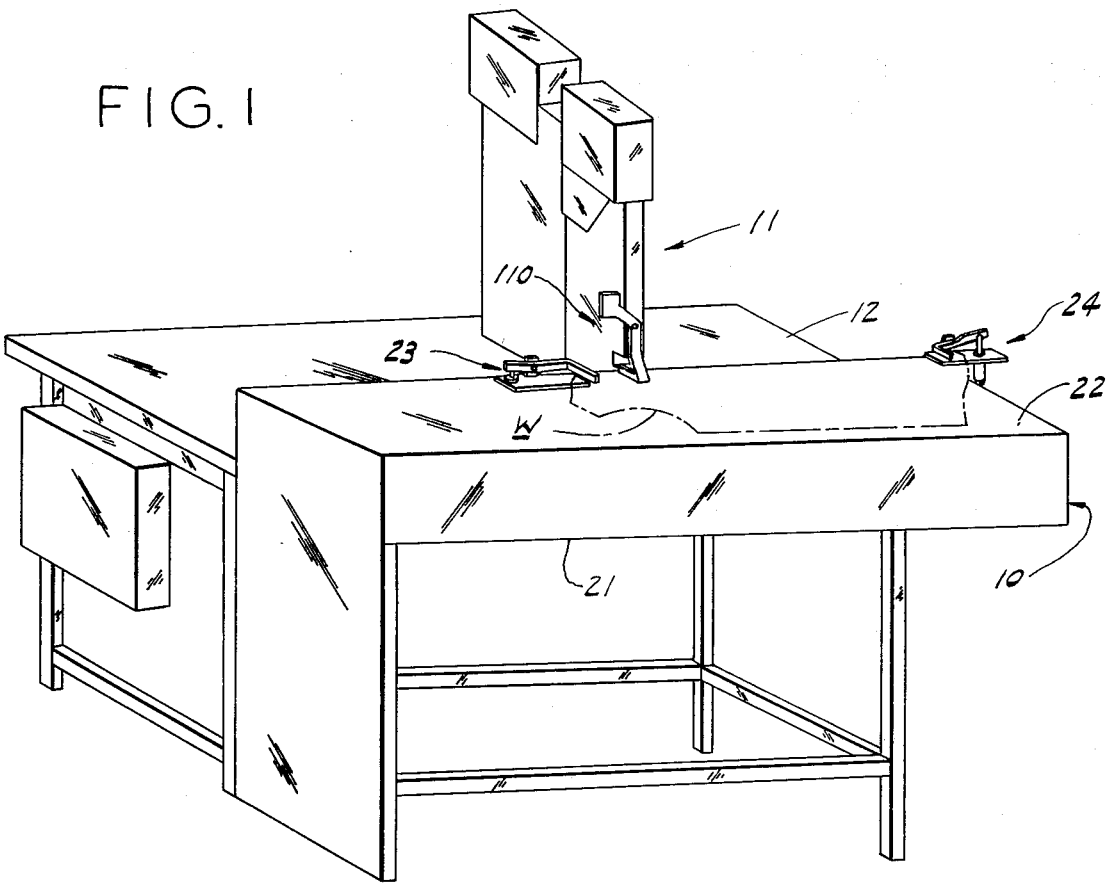
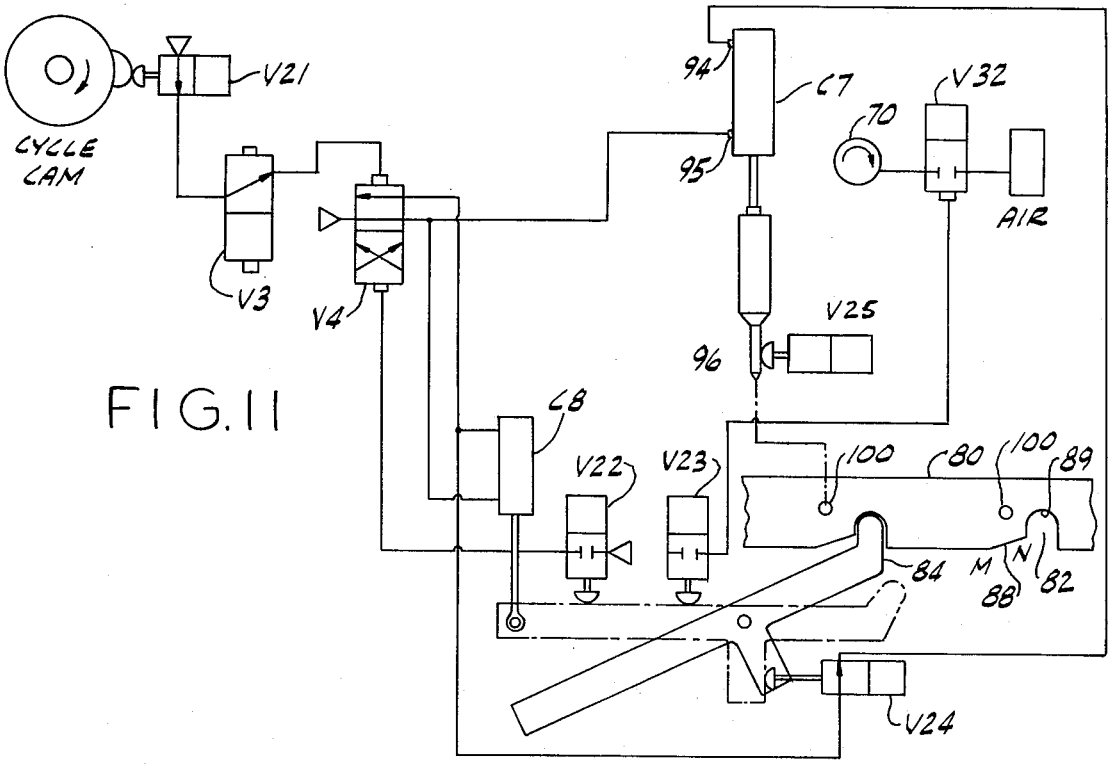
FIG. 11

WORK TRANSPORT APPARATUS FOR USE WITH A BUTTON ATTACHMENT MACHINE

BACKGROUND OF THE INVENTION

This invention relates to apparatus for applying buttons or other types of fasteners to a garment workpiece and has particular reference to an improved transport apparatus by which a workpiece, while held under controlled tension, is moved intermittently with respect to a button attachment machine that sequentially applies buttons thereto.

In the garment industry semi-automatic apparatus is widely used for attaching a series of buttons or other types of fasteners to a garment workpiece. In general, such apparatus includes a carriage by which the workpiece, held in an extended condition, is moved intermittently relative to a button attachment device. Such device sets and secures the fastener elements to the workpiece sequentially, and in a predetermined spaced relationship. Examples of button fastening apparatus of the type herein concerned are disclosed in U.S. Pat. Nos. 3,151,583, and 3,334,600.

SUMMARY OF THE INVENTION

The primary object of the present invention is to improve the operating characteristics and efficiency of sequential button attachment apparatus particularly with respect to the carriage or transport means by which a workpiece is supported any conveyed intermittently and sequentially with respect to the operating head of a machine for installing buttons on the garment workpiece.

More specifically, it is an important object of the invention to provide an improved clamp and tensioner device by which the workpiece is held distended during and between button attachment operations. The improved tensioning means hereof enables each garment part to be held with the same degree of distension regardless of the manner in which the operator installs the workpiece in the holding clamps, that is, loosely or tightly.

It is an object of the present invention to provide tensioning of the workpiece which may be regulated to suit the kind of fabric being processed and which is especially advantageous when operating on knit fabrics because it enables all garment parts to be held with the same amount of stretch, and thereby obtains a uniformity and precision with respect to the spacings of the fasteners on the fabric.

Another object of the invention is the provision of a detector and a control device which functions to stop the operation of the machine in the event that the button attachment machine fails to apply a button at any stage of its operating cycle.

A further object is the provision of a latching and indexing assembly including a locating pin which serves to accurately lock the carriage in place at each button attachment station to augment the workpiece holding provisions and assure proper and uniform spacing of the buttons or snap fasteners on the garment part.

It is an object of this invention to provide a relatively simple and inexpensive work transport apparatus which can readily be used in conjunction with conventional button attachment machines by an operator with a minimum of previous experience and training.

Other objects and advantages will be apparent from the following description.

BRIEF DESCRIPTION OF THE DRAWINGS

FIG. 1 is a perspective view illustrating the work transport apparatus used in conjunction with a button attachment machine;

FIG. 11 is a pneumatic circuit diagram relating to the latching and indexing operation.

DESCRIPTION OF THE PREFERRED EMBODIMENT

Figure 2:
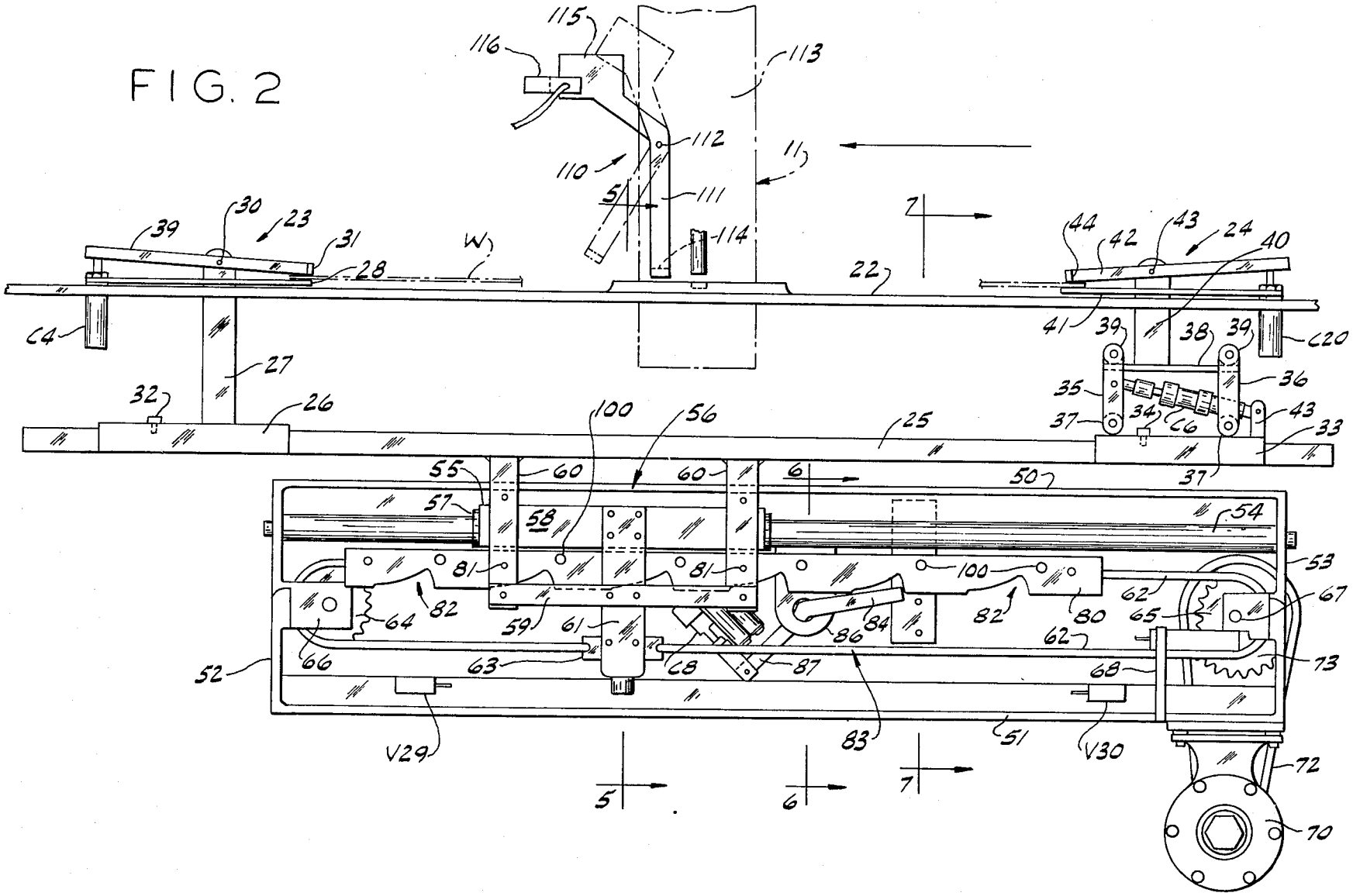
FIG. 2 is an elevational view of the apparatus illustrating the carriage assembly, workpiece clamping units, latching and indexing assembly and button detector assembly.

Referring now by characters of reference to the drawings and first to the simplified perspective of FIG. 1, it will be understood that the work transport apparatus, generally indicated by numeral 10, is used in conjunction with a fastener applicator unit, such as a button attachment machine indicated by numeral 11 and mounted to a base 12. It will of course be understood that the fastener applicator unit could also be a buttonhole sewing machine, a snap fastener machine or any similar unit capable of applying fasteners to a workpiece W such as the garment part held by work transport apparatus 10. The work transport apparatus 10 includes a carriage assembly 20 mounted to a base 21. Carriage assembly 20 which is, for the most part, concealed below a table top 22 provides a mounting for a pair of spaced clamping units 23 and 24 by which the workpiece W is held under tension. The carriage assembly 20 and therefore the clamping units 23 and 24 are advanced linearly in intermittent steps, said carriage assembly 20 being periodically halted when predetermined button attachment points on the workpiece W underlie the operating head of the machine 11.

CLAMP ASSEMBLY

Referring to FIG. 2, the clamping units 23 and 24 are mounted for longitudinal adjustment on a horizontal bar 25 and constitute workpiece holding means. Clamping unit 23, which provides a first workpiece holder, comprises a base part 26, having surface portions shaped to conform to the mounting bar 25. An upstanding bracket arm 27 fixedly attached to base 26 carries an outstanding rectangular plate 28 near its upper end, plate 28 being spaced a slight distance above and projecting forwardly in overlying relation to the rear marginal portion of table 22. A clamping lever 29, attached by pivot 30 to the upper end of bracket arm 27 has a forward end portion bent transversely to constitute a jaw 31, which is arranged to clamp the workpiece W securely against the upper surface of plate 28 and provides a gripping means. A pneumatic actuator C4, consisting of a cylinder and piston unit, is operatively connected to the rear end of the clamping lever 29. The described clamping unit 23 is normally secured in a fixed position on bar 25 by means of a set screw 32 which permits the entire clamping unit to be adjustably positioned longitudinally of the mounting bar 25.

The clamping unit 24, which provides a second workpiece holder is similar to unit 23 except for the provision of means for shifting the clamping elements of unit 24 linearly toward and away from unit 23, and for maintaining a pressure of regulable degree on the workpiece W, whereby to impose a predetermined stretching or tensioning force on said workpiece W. In the preferred embodiment, clamping unit 24 includes a base part 33, which is adjustably secured by set screw 34 to the mounting bar 25. A pair of spaced, upstanding link elements 35 and 36 are pivotally mounted to base part 33 by spaced bearings, indicated by numeral 37 which are fixedly attached to the upper surface of base part 33. An upper part provided by a horizontal bar 38, having spaced bearings 39 fixedly attached to the upper surface thereof, pivotally interconnects the upper ends of links 35 and 36; and bar 38, links 35 and 36 and the base part 33 cooperate to constitute a quadrilateral or four-bar linkage system. An upstanding bracket arm 40, fixedly attached to bar 38, carries an outstanding plate 41 near its upper end, plate 41 being spaced slightly above table 22. A clamping lever 42, attached by pivot 43 to the upper end of bracket arm 40, has a forward end portion bent to provide a clamping jaw 44, which provides a gripping means. A pneumatic actuator C20 is arranged to move jaw 44 of lever 42 to clamp workpiece W against the upper surface of plate 41 in the same manner that jaw 31 acts to clamp said workpiece W to the plate 28 of clamp unit 23.

A piston and cylinder pneumatic actuator C6 is pivotally connected at one end to an upper portion of link 35 and at the opposite end to a short bracket arm 43 secured to base part 33. It will be understood that air pressure in the cylinder of C6 on one side of the piston head retracts the piston and by virtue of the four-bar linkage system tends to move the upper portion of the clamping unit 24 away from the relatively fixed clamping unit 23. Pressure on the opposite side of the piston head has the reverse effect. The pressure of air transmitted to the cylinder of C6 to retract the clamping arms is adjustably controlled by a pressure regulator, (not shown) as will be described. By suitably adjusting the air pressure, the tensioning forces on a fabric workpiece held by and between the clamping jaws of units 23 and 24 can be regulated to accord with the character of the workpiece material. For example, a relatively stretchy, loosely woven material will require less tensioning pressure on the clamping members than would a strongly resistant tightly woven material. The advantage derived from the described clamping means is that the constant, uniform pressure that is applied to the workpieces, which are manually fed into the clamping parts by an operator, assures that the spacings between buttons or snap fasteners will be uniform throughout an entire batch. This is to say that the operator is required merely to feed the workpieces into the clamping units. The amount of tension or stretch applied to the workpiece is determined automatically by the air pressure supplied to the actuator C6.

CARRIAGE AND DRIVE ASSEMBLY

With special reference to FIGS. 2, 3 and 4, the carriage assembly 20, and its drive and indexing mechanism, is mounted on an elongate rectangular support frame 48, which is mounted to the base 21 below the table top 22 and constitutes a support means. The frame 48 includes a horizontal upper member 50, a horizontal lower member 51, and end members 52 and 53. A guide rail, in the form of a rod 54, extends between and has its ends secured to the end members 52 and 53 of the support frame 48. The carriage assembly 20, which constitutes a carriage means, is mounted for horizontal movement on guide rod 54, and includes a tubular member 55, (FIG. 6) received by said rod 54 in sliding relation, and a generally rectangular carriage frame 56 rigidly secured to said member 55. The frame 56 includes a horizontal member 58 welded or otherwise attached to said tubular member, a lower horizontal member 59 and end members 60 also rigidly attached. The end members 60 extend upwardly and are rigidly connected at their upper ends to bar 25, which they serve to support. The carriage frame 56 also includes an intermediate upright member 61 rigidly attached to and extending downwardly from member 58, which projects to a point below the lower frame member 59 and is provided with a chain attachment bracket 63 at the lower end.

The described carriage assembly 20, comprising essentially the horizontally slidable tubular member 55 and attached carriage frame 56, provides a support for the fixedly attached horizontal bar 25 and the workpiece clamping units 23 and 24 mounted thereto, and is driven by an endless chain belt 62, the lower flight of which is secured to the bracket 63 at the lower end of the depending frame member 61. Chain belt 62 is supported by and between a pair of chain belt sprockets 64 and 65 which are mounted for rotation on bearing brackets 66 and 67 respectively, which project inwardly from and are secured to the side members 52 and 53 of the relatively fixed mounting frame 48. A belt adjustment device indicated generally at 68 is operatively associated with sprocket 65 and serves to shift said sprocket for purposes of maintaining proper belt tension. A reversible air driven motor 70 mounted on the lower frame bar 51, is connected by a chain belt 72 to a sprocket 73, which is rigidly secured in coaxial relation to sprocket 65. As will hereinafter be explained the reversible air powered motor 70 serves to drive the carriage assembly in either a forward or a reverse direction between limit points as determined by a location of end valves V29 and V30 that control the direction of flow of pressurized air into the air motor 70.

LATCHING AND INDEXING ASSEMBLY

Figures 5, 6, 7, 8:
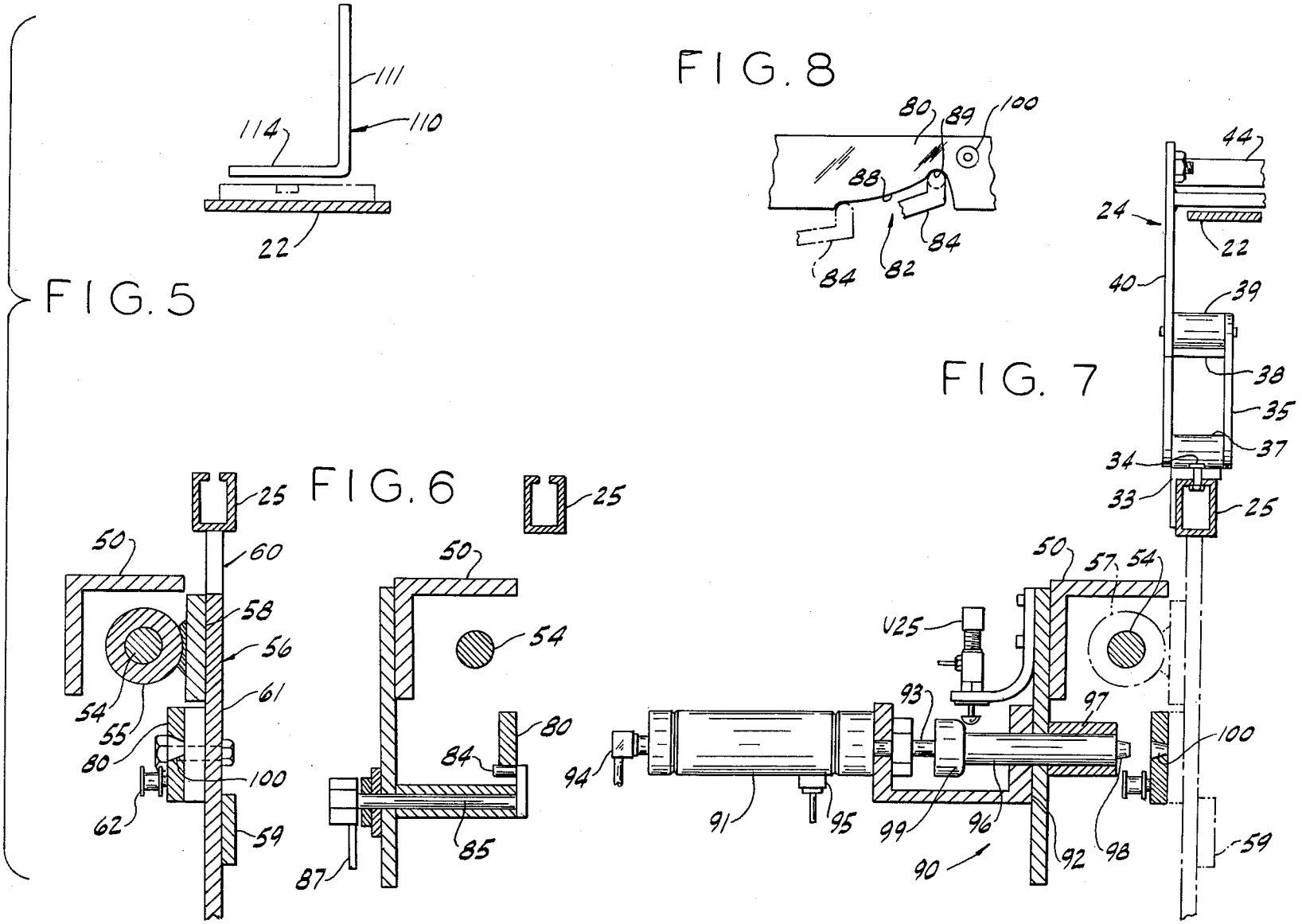
FIG. 5 is an enlarged, fragmentary transverse sectional view taken on line 5—5 of FIG. 2.
FIG. 6 is a transverse sectional view taken on line 6—6 of FIG. 2.
FIG. 7 is a transverse sectional view taken on line 7—7 of FIG. 2.
FIG. 8 is an enlarged fragmentary view of the indexing bar.

Again referring to FIGS. 2 and 3 there is provided a horizontally disposed indexing bar 80, which is detachably secured by machine screws 81, to the vertical carriage frame members 60. The replaceable indexing bar 80 is characterized by a plurality of spaced latch recesses or notches 82 formed in the lower edge portion of said bar constituting latch engagement means and corresponding to the number and spacing of buttons required on the particular workpiece W. Each of the notches 82, as best shown in FIG. 8, includes an inclined lead portion 88 and a relatively deeper portion defined by a stop shoulder and engageable by the base portion of a pivoted lever or pawl member 84, which provides a latch means that is swingable into and out of engagement with said indexing bar notches 82. As shown in FIG. 6, pawl 84 projects at a right angle from one end of a shaft 85, which is journaled on bearing brackets 86 secured to and depending from the upper horizontal frame member 50 of the support frame 48. A crank arm 87 is secured to the opposite end of the shaft 85, and operatively connected to the outer end of crank arm 87 is the piston or plunger rod of a pneumatic actuator C8. Also shown installed on the bracket arm 86, as shown in FIG. 3, are a pair of pneumatic valves V22 and V23, arranged for actuation by the latch assembly 83, which control the operation of the drive motor 70, as will hereinafter be explained.

Figure 4:
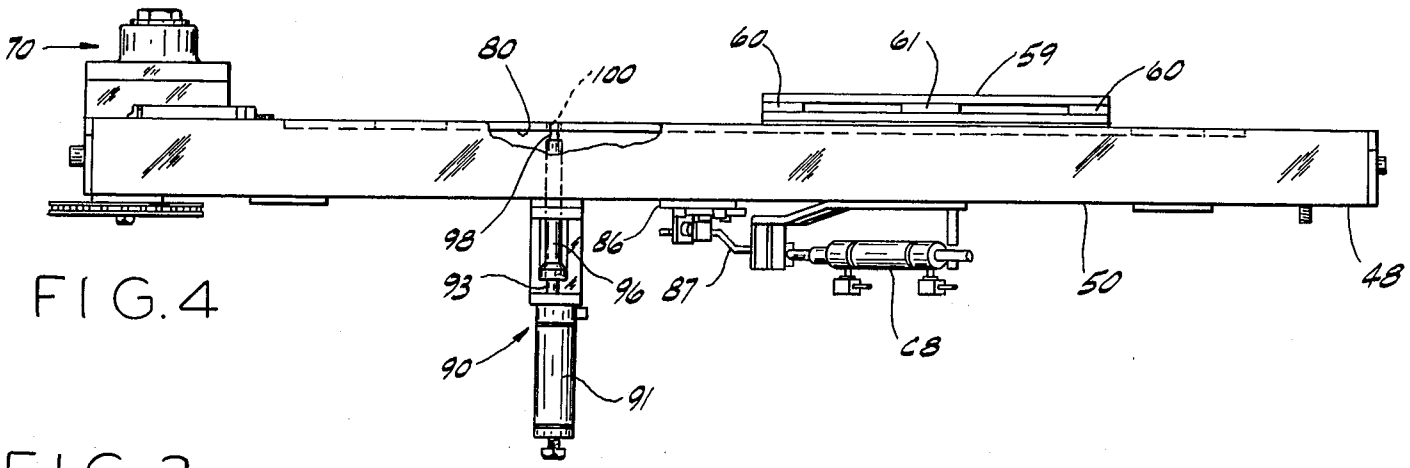
FIG. 4 is a top plan view showing portions of the carriage assembly and the latching and indexing assembly shown in FIG. 3.
Figure 3:
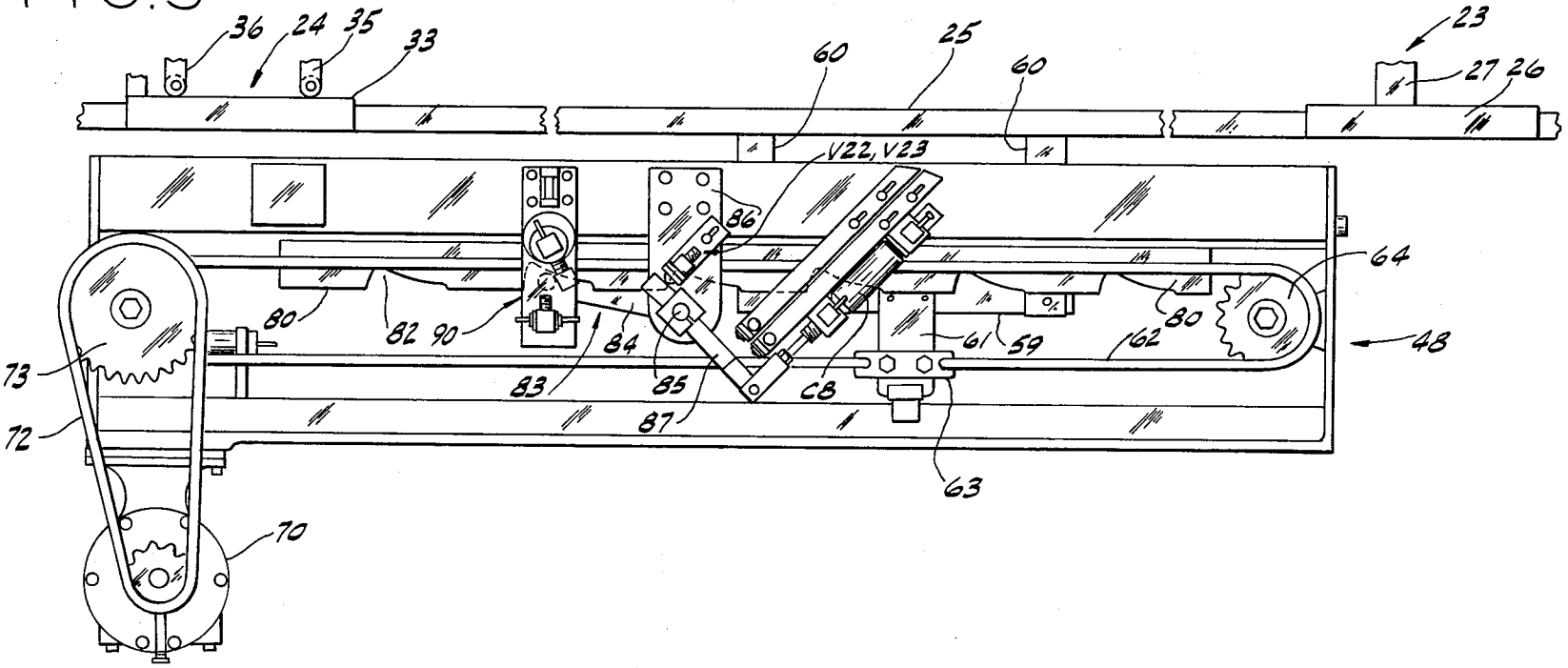
FIG. 3 is a rear elevational view illustrating the carriage assembly and the latching and indexing assembly.

With particular reference to FIGS. 3, 4 and 7 there is provided a locking unit generally indicated by numeral 90 by which the carriage assembly 20 is positively located and locked in place during the intervals during which the button attachment machine 11 is operating to set and fasten buttons onto the workpiece W. The locating unit 90, which constitutes a positive locating means includes a double acting air cylinder 91 mounted on a bracket arm assembly 92, which depends from and is attached to support frame member 50, said cylinder 91 having its longitudinal axis perpendicular to the side surface of the indexing bar 80. Cylinder 91 includes a piston 93 and air inlet fittings 94 and 95. The piston 93 is extended pneumatically by a charge of compressed are delivered to the cylinder 91 through fitting 94, and retracted by compressed air delivered through fitting 95. A locating and locking pin 96, connected to the remote end of the piston 93, is slidably mounted in a guide bushing 97 which forms part of the bracket assembly 92. Locating pin 96 terminates at its outer end in a tapered nose 98, and has a camming collar 99 on its inner end. Collar 99 actuates the control plunger of an air valve V25 when the bolt 96 is disposed in an extended or locking position with respect to the indexing bar 80. As shown in FIG. 2 the indexing bar 80 is provided with a series of longitudinally spaced conical recesses or openings 100 in the side of indexing bar 80 to snugly receive the locating nose 98 of the pin 96 when the carriage frame 56 is precisely located at any one of its button attachment stations.

BUTTON DETECTOR ASSEMBLY

With reference to FIG. 2 there is provided a button detector for stopping machine operation in the event that the button attachment machine 11 fails to set a button at the predetermined location on the workpiece W. The detector assembly, generally indicated by numeral 110, is located closely adjacent to the operating head of the button attachment machine 11, on the so-called downstream side thereof and constitutes a sensing device. The button detector assembly 110 includes a pivoted sensing arm 111 which is suspendingly mounted on a pivot pin 112. The lower end of the sensing arm 111 is bent at right angles to form a horizontal finger 114 (FIG. 5) that extends into the path of movement of a button that has been applied to the workpiece W and is moving away from the attachment machine 11. A vane-like part 115, carried by the upper end of the sensing arm 111, acts as a valve element in an air control circuit designated 116. When the sensing arm 111 is displaced by a properly applied button moving with the workpiece W the flow of air through control line 116 actuates another air valve (not shown) to hold the system in operative condition. Should sensing arm 111 not be displaced, reflecting a malfunctioning of the button machine in that instance, air power to motor 70 would be cut off and the carriage assembly 20 would stop. This will be further explained in connection with the description of operation that follows.

OPERATION

The operation of the apparatus described above with reference to FIGS. 1–8 will now be discussed with particular reference to the pneumatic circuit diagrams of FIGS. 9–11.

WORKPIECE CLAMPING AND TENSIONING

Figure 9:
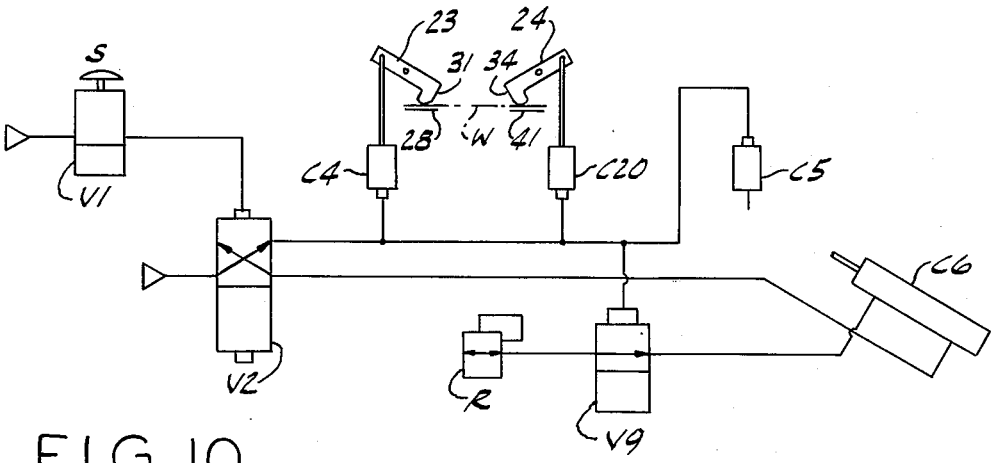
FIG. 9 is a pneumatic circuit diagram relating to the clamping and tensioning operation.

This operation is best understood by reference to FIG. 9. At the beginning of a button fastening operation the carriage assembly 20 is disposed in the start position with the jaws of the clamping units 23 and 24 raised. The operator manually inserts the ends of the workpiece W onto the clamping plates 28 and 41, below the raised jaws 31 and 44, and presses the start button S. This opens valve V1 which transmits a charge of compressed air to valve V2, causing that valve to open and energize the pistons of clamp actuators C4 and C20, to move the jaws 31 and 44 into clamping engagement with the workpiece W. At the same time valve V9 also shifts to an open position and sends a charge of air to the tensioning cylinder C6. This causes retractive movement of clamping unit 24, the opposite end of which is held fixed by clamping unit 23, with the result that tension is applied to the workpiece W. It should be noted that the pressure of air supplied to valve V9 may be regulated by means of a pressure regulator R so that the degree of tension applied to the workpiece W during the button fastening operation is consistent with the type of material used for the particular garment part providing the workpiece.

BUTTON DETECTING

Figure 10:
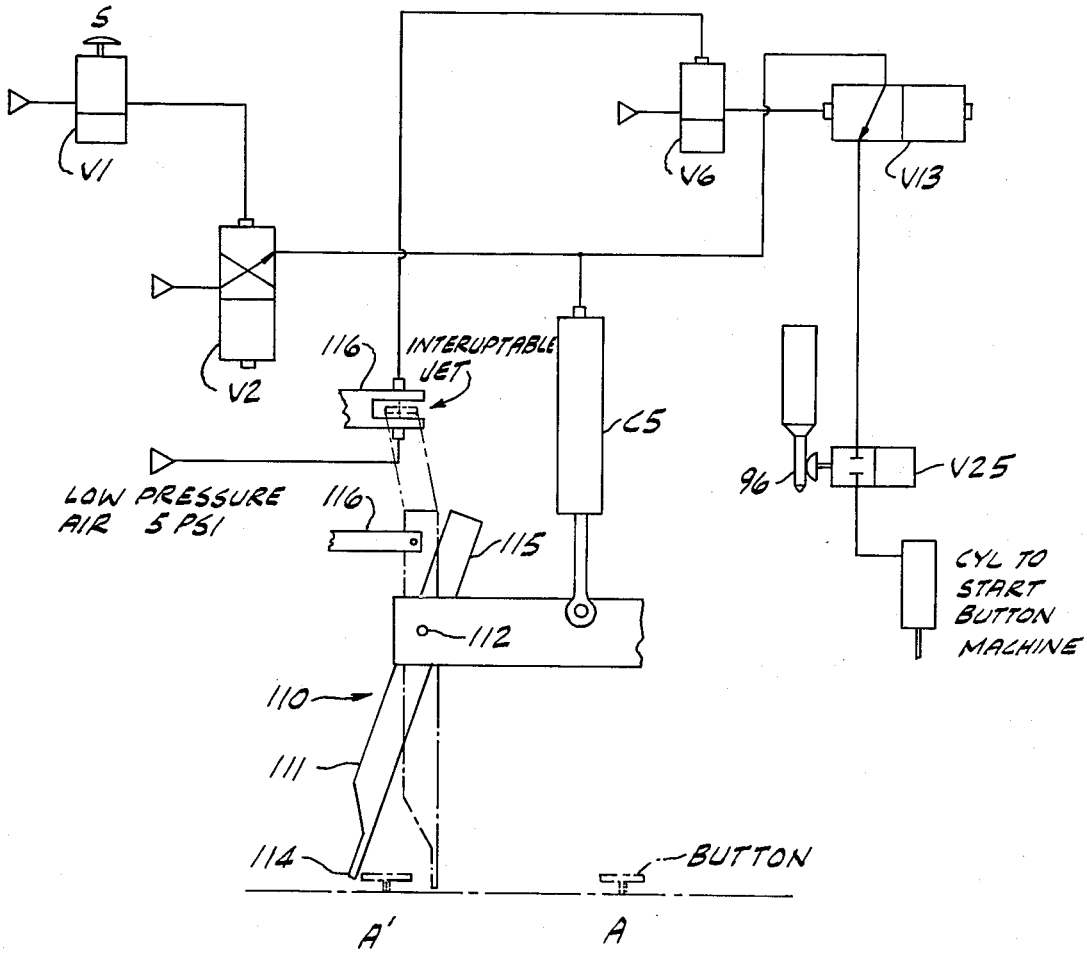
FIG. 10 is a pneumatic circuit diagram relating to the button detector operation.

This operation is best understood by reference to FIG. 10. An actuator C5 also responds to a charge of compressed air from the same line that serves clamp actuators C4 and C20 and functions to lower the sensing arm 111 of the button detector assembly 110, moving the sensing finger 114 into the path of movement of button positions on the workpiece W. The button detector assembly 110 functions to halt the carriage assembly 20 and prevent any subsequent and successive fastening operations of the button attachment machine 11 in the event that said machine fails to function.

In describing the seqence of operation of the button detector assembly 110, let it be assumed that the detector sensing finger 114 has been lowered by C5 as previously described, and that the carriage assembly has shifted or indexed a button previously attached to the workpiece W from position A to A′ at the completion of a button attaching operation. The moving button engages and shifts the sensing finger 114 causing the upper end of the sensing arm 111, acting as a valve part, to allow an interruptable jet of low pressure air to pass into the cylinder of a valve V6. High pressure air passing through valve V6 shifts valve V13 and thereby conditions button attaching machine 11 to initiate another cycle of button attaching operations when the positive locating pin 96 is in a retracted position, thereby determining the position of the control plunger of valve V25. At the end of a series of button setting operations actuator V3 is restored to its initial condition, initiated by a valve 21 (FIG. 11), in response to a cycle cam on the button machine. This will be further explained in connection with the following description of the indexing and latching sequence of the work carriage assembly 20.

CARRIAGE INDEXING AND LATCHING SEQUENCE

The indexing and latching operations are best understood by reference to FIG. 11, in which there is represented a cycle cam on the button attachment machine. This cam completes one revolution during each button fastening operation of the machine. At the completion of an attachment cycle, valve V21 opens to transmit a charge of compressed air to the actuator of valve V3. Valve V3 transmits a charge of compressed air to valve V4 which opens, sending a charge of air to the locating pin actuator C7, causing the locating pin 96 to be withdrawn from the associated indexing bar recess 100. The positive locating or locking pin 96 also functions as a cam (see FIG. 7) for a plunger follower which controls the valve V25, previously referred to in connection with the operating description of the button detector assembly 110. Thus, when the positive locating pin 96 is retracted by C7 the control plunger of V25 slides from a relatively large diameter to a small diameter portion of the locating pin 96, which opens valve V25 and initiates a subsequent cycle of operation of the button attachment machine 11.

Returning now to circuit conditions following the opening of valve V4, it will be understood that air, in addition to actuating C7, passes to the lower end of an actuator cylinder C8. The actuation of cylinder C8 swings the latch assembly pawl 84 out of engagement with the associated indexing bar latch notch 82. The aforesaid retractive movement of the latch assembly actuates three valves, V22, V23 and V24 associated with the said latch assembly. Firstly, V23 opens to transmit a charge of compressed air to the actuator of valve V32 which controls the operation of an air driven motor 70. Motor 70 is operatively connected by a suitable drive chain 62 to the carriage assembly 20 (FIG. 2) and said carriage assembly is thereby caused to move longitudinally relative to the latch pawl 84 and the locating pin 96 in a direction toward the next button applying location, the indexing bar 80, of course, moving with the carriage frame 56 to which it is attached. As the indexing bar 80 advances, the nose of the pawl 84 bears upwardly against the lower undersurface of the indexing bar 80 which extends between the latch notches 82. As the pawl 84 (relatively speaking) approaches the next succeeding indexing bar notch 82, it first encounters the inclined undersurface of the first notch portion 88 beginning at the point M leading toward the point N and the second notch portion 89. As the pawl nose leaves the horizontal undersurface and starts into the inclined undersurface at point M the actuator of valve V23 closes, cutting off the pressure to the actuator of valve V32 which closes, cutting off the supply of driving air to the air motor 70. The inertia of the motor 70 continues to move the carriage frame 56 and indexing bar 82, and during this phase the actuator of valve V22 opens to transmit a charge of compressed air to the actuator of valve V4, shifting that valve so as to extend the latch actuator C8, thereby driving the latch pawl 84 into the notch portion 89. This final latching movement opens valve V24 sending a charge of compressed air to the upper or outer end of actuator cylinder C7 at 94 which drives the positive locating pin 80 into an aligned closely fitting locating pin recess 100 in the indexing bar 80 and brings the carriage frame 56 to an accurately positioned halt without rebound or vibration of the carriage assembly. During the extension of the positive locating pin 80 into place, the control plunger of valve V25 is actuated (FIG. 7) and said valve V25 is held in open condition by the pin 80 to send a charge of air to the cylinder (FIG. 10) that starts the button attachment machine.

This cycle of events is repeated until the number of buttons, determined by the number of notches 82 in the indexing bar 80, are set and secured in place on the workpiece W. At such point in the sequence of operations of a valve V29, mounted to the support frame 48 (FIG. 2), is actuated by engagement with the carriage frame 56 to send a charge of air to cause valve V2 (FIG. 10) to shift in turn, releasing the pressure from clamp cylinders C-4 and C-20. The jaws of the clamping units 23 and 24, which are lightly biased by return springs (not shown) are then restored to open position to permit the release of the workpiece W. Actuator C6 is extended to return the clamping unit 24 to a non-tensioning position, locating pin actuator C7 and latch actuator C8 disengage said latch and pin from the indexing bar and release the work-carriage. A charge of air is supplied to the air motor 70 in a direction to drive it and the carriage assembly 20 in a reverse direction into actuating engagement with valve V30 (FIG. 2) to restore the carriage assembly 20 to starting position.

I claim as my invention:

1. A work transport apparatus for use with a fastener applicator unit for attaching fastener elements to a garment workpiece, said transport apparatus comprising:

a. support means, b. carriage means mounted to the support means for linear movement relative to the applicator unit, c. drive means for advancing said carriage means intermittently between fastener applicator stations, d. workpiece holding means mounted for movement with the carriage means including:

1. a first workpiece holder having means for gripping a portion of the workpiece,
2. a second workpiece holder disposed in spaced relation from the first workpiece holder and having means for gripping another portion of the workpiece, and
3. means for moving one of said holders linearly relative to the other of said holders to apply tension to the workpiece, e. latching and indexing means between said support means and carriage means including:

1. movable latch means on one of said means,
2. latch engagement means on the other of said means including a plurality of linearly spaced recesses receiving said latch means successively at predetermined intervals,
3. positive locating means cooperating with said latch means to accurately locate the carriage means at the fastener stations, and f. actuating means associated with said latching and indexing means for actuating said positive locating means and for actuating said drive means.

2. A work transport apparatus as defined in claim 1, in which:

g. said latch and indexing means includes an elongate indexing bar mounted to the carriage means, and having a plurality of linearly spaced notches therein providing said spaced recesses, and having a plurality of linearly spaced openings therein, and said latch means is pivotally mounted to said support means for engagement within said notches, and h. said positive locating means includes a transversely movable pin receivable within said openings and having a configuration to provide a close fit within said openings, and pin actuating means operatively actuated by engagement of said latch means within one of said notches.

3. A work transport apparatus as defined in claim 2 in which:

i. first fluid control means connected to said drive means and operable by said latch means upon engagement of the latch means with the first portion of the proximate latch notch for deactuating said drive means, and j. second fluid control means operatively connected to said locating pin and being operable upon engagement of the latch means within the second portion of the proximate latch notch for moving said locating pin into a locking position.

4. A work transport apparatus for use with a fastener applicator unit for attaching fastener elements to a garment workpiece, said transport apparatus comprising:

a. support means, b. carriage means mounted to the support means for linear movement relative to the applicator unit, c. drive means for advancing said carriage means intermittently between fastener application stations, d. workpiece holding means mounted for movement with the carriage means, e. latching and indexing means between said support means and carriage means including:

1. movable latch means on one of said means, 2. latch engagement means on the other of said means including a plurality of linearly spaced recesses receiving said latch means successively at predetermined intervals, 3. positive locating means cooperating with said latch means to accurately locate the carriage means at the fastener stations, and f. actuating means associated with said latching and indexing means and cooperating with said applicator unit for actuating said positive locating means and for actuating said drive means.

5. A work transport apparatus as defined in claim 4, in which:

g. sensing means engageable by a fastener on the workpiece operatively actuates the fastener applicator unit to permit succeeding fastener applications.

6. A work transport apparatus as defined in claim 5, in which:

h. said sensing means includes an arm pivotally mounted to the fastener applicator unit and having a sensing finger disposed in overlying relation to the workpiece to intercept the path of a fastener on said workpiece, said arm being swingable into a fastener applicator unit actuating position.

7. A work transport apparatus for use with a fastener applicator unit for attaching fastener elements to a garment workpiece, said transport apparatus comprising:

a. support means, b. carriage means mounted to the support means for linear movement relative to the applicator unit, c. workpiece holding means mounted for movement with the carriage means including:

1. a first workpiece holder having means for gripping a portion of the workpiece, 2. a second workpiece holder disposed in spaced relation from the first workpiece holder and having means for gripping another portion of the workpiece;

3. means for moving one of said holders linearly relative to the other of said holders to apply tension to the workpiece, d. each of said holders includes pneumatically actuated jaw members, and e. one of said holders includes pneumatically actuated relatively movable portions providing the means for moving said holders relative to each other.

8. A work transport apparatus for use with a fastener applicator unit for attaching fastener elements to a garment workpiece, said transport apparatus comprising:

a. support means, b. carriage means mounted to the support means for linear movement relative to the applicator unit, c. workpiece holding means mounted for movement with the carriage means including:

1. a first workpiece holder having means for gripping a portion of the workpiece, 2. a second workpiece holder disposed in spaced relation from the first workpiece holder and having means for gripping another portion of the workpiece;

3. means for moving one of said holders linearly relative to the other of said holders to apply tension to the workpiece, d. said one holder includes upper and lower portions and link means interconnecting said portions to define a quadrilateral linkage means, and e. actuator means moves said upper and lower portions relative to each other, said linkage means and said actuator means providing the means for moving said holders relative to each other.

9. A work transport apparatus for use with a fastener applicator unit for attaching fastener elements to a garment workpiece, said transport apparatus comprising:

a. support means, b. carriage means mounted to the support means for linear movement relative to the applicator unit, c. drive means for advancing said carriage means intermittently between fastener application stations, d. workpiece holding means mounted for movement with the carriage means, e. latching means between said support means and carriage means including:

1. movable latch means on one of said means, 2. latch engagement means on the other of said means cooperatively receiving said latch means at successively predetermined intervals of movement of said carriage means, f. indexing means between said support means and said carriage means including:

1. a locating element on one of said means, 2. locating element receiving means on the other of said support and carriage means cooperating with said locating element to accurately locate the carriage at the fastener applicator stations, and g. actuating means associated with said latch means for actuating said drive means in timed relation to disengagement of said latch engagement means.

10. A work transport apparatus as defined in claim 9, in which:

h. said locating element comprises an elongate locating pin, and i. said locating element receiving means comprising an index bar having a plurality of linearly spaced openings for receiving said locating pin.

11. A work transport apparatus as defined in claim 10, in which:

h. said locating pin carries a tapered nose, and i. said index bar openings are complementarily contoured to receive said pin tapered nose.

12. A work transport apparatus as defined in claim 10, in which first fluid-operated means for moving said locating pin into, and retracting said pin from, the proximate index bar opening.

13. A work transport apparatus as defined in claim 12, in which:

i. control means connected to said first fluid-operated means for actuating same for moving said locating pin into the proximate opening in timed relation to reception of said latch means by said latch engagement means.

14. A work transport apparatus as defined in claim 13, in which:

j. second fluid operated means for effecting engaging and disengaging action of said latch means and said latch engagement means.

15. A work transport apparatus as defined in claim 9, in which:

h. fluid actuating means connecting said latch means and said drive means for actuating the latter sequentially upon disengagement of the latch means from the latch engagement means.

16. A work transport apparatus as defined in claim 9, in which:

h. said locating element receiving means comprises an index bar having a plurality of linearly spaced openings, i. said index bar being mounted to said carriage means for travel therewith, j. said locating element comprising an elongated locating pin presented in axially perpendicular relationship to the path of travel of said index bar, and being dimensioned for reception within said index bar openings, and k. means supporting said locating pin on said support means.

17. A work transport apparatus as defined in claim 16, in which:

l. said movable latch means is mounted on said support means, and m. said latch engagement means comprises a plurality of linearly spaced edge recesses provided on said index bar, there being a locating pin receiving opening adjacent each of said recesses.

* * * * *